United States Patent [19]

Kadien

[11] Patent Number: 4,934,586

[45] Date of Patent: Jun. 19, 1990

[54] ARCHED CLAMSHELL TYPE CONTAINER

[75] Inventor: Thomas G. Kadien, Germantown, Tenn.

[73] Assignee: International Paper Company, Purchase, N.Y.

[21] Appl. No.: 399,059

[22] Filed: Aug. 28, 1989

[51] Int. Cl.[5] ..... B65D 5/46

[52] U.S. Cl. ..... 229/117.14; 229/127; 229/911; 229/914

[58] Field of Search ..... 229/117.13, 117.14, 229/910, 911, 914, 127

[56] References Cited

U.S. PATENT DOCUMENTS

| | | | |
|---|---|---|---|
| 3,150,769 | 9/1964 | Cohn | 229/117.14 |
| 3,377,015 | 4/1968 | Moreno | 229/117.14 |
| 3,722,782 | 3/1973 | Collie | 229/117.14 |
| 4,017,017 | 4/1977 | Vos | 229/117.14 |
| 4,238,069 | 12/1980 | Morris, Jr. | 229/911 |
| 4,307,834 | 12/1981 | Roccaforte | 229/117.14 |
| 4,399,939 | 8/1983 | Tunick | 229/117.14 |
| 4,651,919 | 3/1987 | Wischusen, III | 229/117.14 |
| 4,678,079 | 7/1987 | Henning | 229/117.14 |

FOREIGN PATENT DOCUMENTS

| | | | |
|---|---|---|---|
| 1267551 | 6/1961 | France | 229/117.14 |
| 7805903 | 12/1979 | Netherlands | 229/117.14 |
| 283612 | 10/1952 | Switzerland | 229/117.14 |

*Primary Examiner*—Gary Elkins

*Attorney, Agent, or Firm*—Michael J. Doyle

[57] ABSTRACT

An arched clamshell type carton formed from a one piece blank of paperboard having cut lines and score lines. The bottom of the carton is square, with each of two opposite sidewalls having spaced apart, coplanar ears, each of the latter being semicircular. The other two opposite sidewalls of the bottom are elongated and are each bent around the edges of respective opposite, aligned ears. The ends of these latter walls carry hooks and also handle forming panels, the hooks being each engaged with a respective latching flap positioned between respective pairs of ears.

7 Claims, 3 Drawing Sheets

FIG. 4
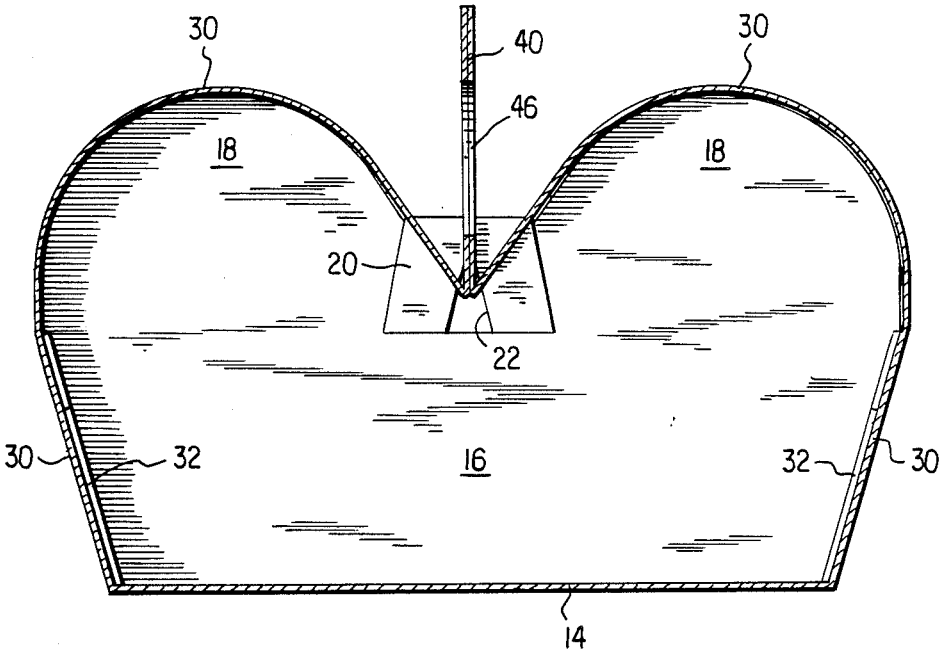
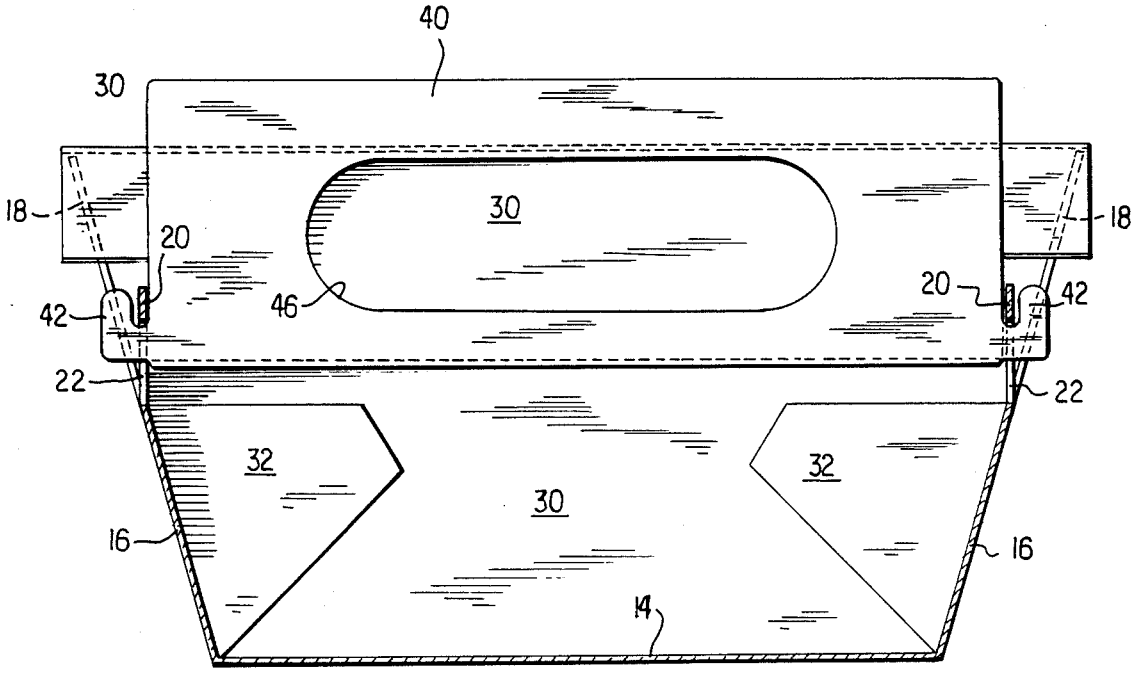
FIG. 5

ARCHED CLAMSHELL TYPE CONTAINER

BACKGROUND OF THE INVENTION

This invention relates to paperboard cartons or containers of the clamshell type currently in vogue for packaging hamburgers and the like at fast food outlets. Such containers are characterized by a rectangular dish, bottom and a similarly shaped, inverted cover, the bottom and cover formed as a unit of either paperboard or a plastic material. The bottom and cover are usually integrally hinged together.

Standard clamshell cartons are formed from a flat blank into a hinge cover structure. The two cells that are created are attached at the hinge.

In order to form the clamshell, the hinge must be preformed before the carton is set up. There are three main basic methods now employed in this art. In the first, the blank is picked up by vacuum from the hopper. As the feed bar gate moves downward the hinge is broken by a cam action mounted on the feed bar. The blank with formed hinge is placed into the female cavity. In the second, the blank is picked up by vacuum and deposited onto the female forming frame. As the blank rests in the frame, folding blades are activated beneath the frame forming the hinge. In the third method, the blank is fed by vacuum and placed into a lug conveyor. The blank is then transported through a folding section where plows form the hinge. The blank with formed hinge is then conveyed and indexed into the female forming frame. Each of these methods limits the number of blanks that can be placed in a feed hopper.

Further, the conventional clamshell type carton has no handle structure and must accordingly be carried by the retail customer by squeezing it.

SUMMARY OF THE INVENTION

The carton of this invention does not require hinge forming. Therefore, the blank may be placed in the hopper, with the long dimension up. Depending on comparative sizes, it is possible to run twice as many up of the carton of this invention in the same size forming frame. Although standard clamshell type cartons generally consist of two cells, the head to form this style clamshell is considered a single forming head. It is the carton style change for the new carton rather than the head that allows for forming more cartons in the same space than a conventional clamshell.

The carton of this invention is formed from a unitary blank of paperboard, although other sheet materials which are stiff, resilient and foldable, such as some plastics, can be employed. The blank is provided with cut and score lines for folding and gluing. An integral handle is defined by apertured panels of the blank. The carton is partially set up or erected by a single forming head or mandrel. The partially erected cartons are then nested together, as in batches, for shipment to a fast food outlet where they are sequentially filled with a hamburger or other food product, closed and then given to the purchaser.

BRIEF DESCRIPTION OF THE DRAWINGS

FIG. 4 is a section along 4—4 of FIG. 2.

FIG. 5 is a section along 5—5 of FIG. 2.

DETAILED DESCRIPTION OF THE INVENTION

Figure 1:
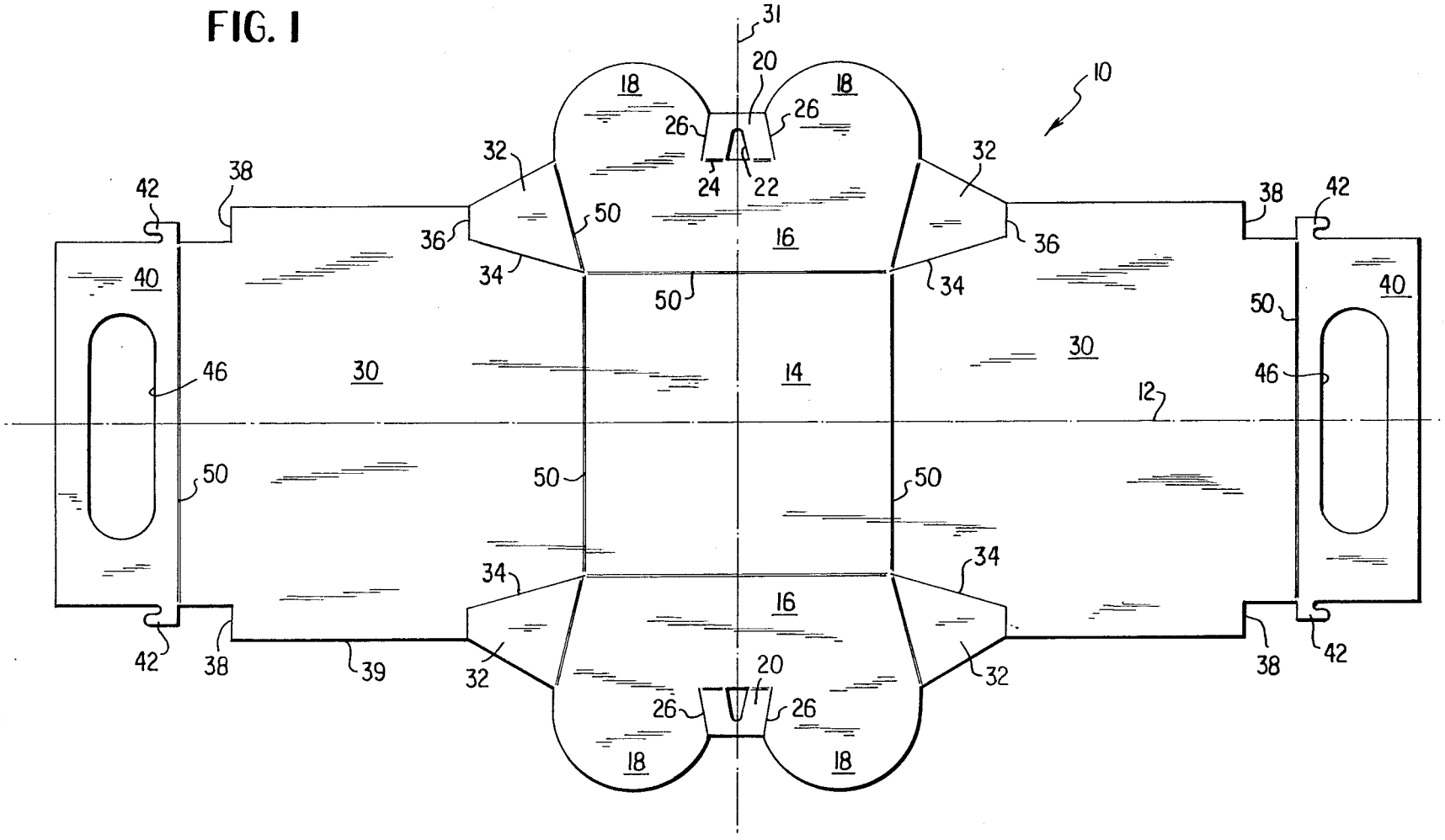
FIG. 1 is a plan view of the unitary paperboard blank from which the carton of this invention is formed.
Figure 2:
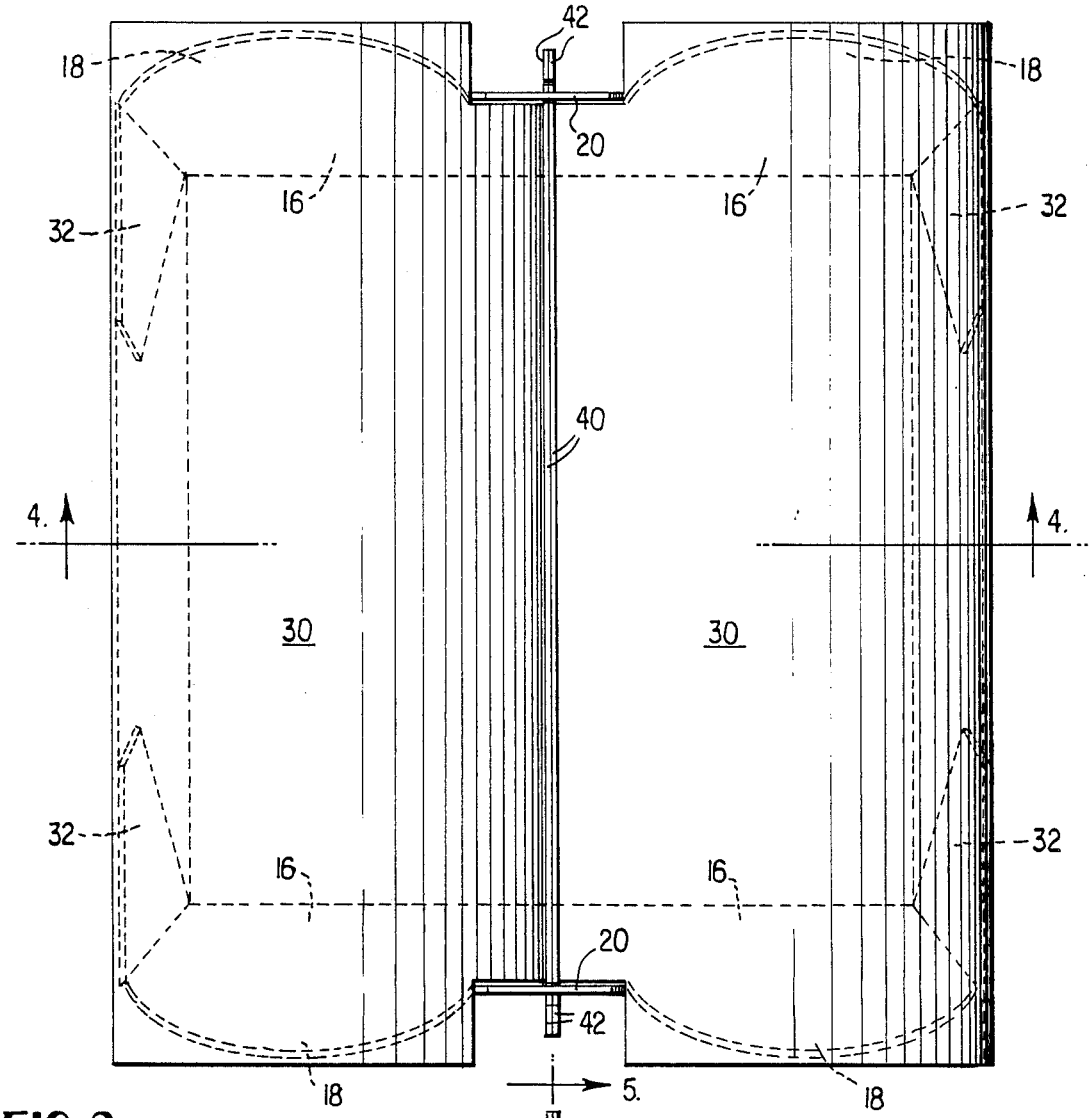
FIG. 2 is a top plan view of the erected blank, being the carton.

Referring now to FIG. 1 of the drawings, the one piece blank from which the container of this invention is formed is illustrated. The blank is noted generally by the numeral 10 and is mirror symmetrical about longitudinal axis 12. The numeral 14 denotes a bottom forming or central panel to which is foldably joined upper and lower side forming panels 16. Each of the latter is provided with a pair of upwardly projecting ears of generally semicircular form, each ear denoted by the numeral 18. A locking or latching tab 20 is situated between each pair of ears 18 on a respective panel 16, each locking tab being provided with a central opening or aperture 22 and hingeably secured to its respective end panel 16 by a pair of hinged or fold lines 24 on either side of opening 22. These locking panels are separated from adjacent ears 18 by cut lines 26. Glue flaps 32 extend laterally from both sides of a respective panel 16 and are defined by cut lines 34 and 36.

The numeral 30 denotes either of two side and top closure forming panels secured to the right and left ends of central panel 14. A vertically extending axis 31, transverse to longitudinal axis 12, divides the mirror symmetrical left and right halves of the blank.

Side wall and top closure forming panels 30 are each provided with a pair of notches 38 on opposite sides of axis 12, at the portion of panel 30 remote from central panel 30, with panels 30 each hingeably carrying a respective handle panel 40 at its remote end. The handle panels are each provided with a pair of hooks 42 near the fold line with panel 30, with the handle panels also each being provided with an opening 46 for forming a finger recess.

The numeral 50 denotes any of the several double lines indicated at FIG. 1, with each of these lines 50 indicating a hinge or fold line.

The material of construction of blank 10 is preferably paperboard, although any other stiff, resilient and foldable material may be employed.

Figure 3:
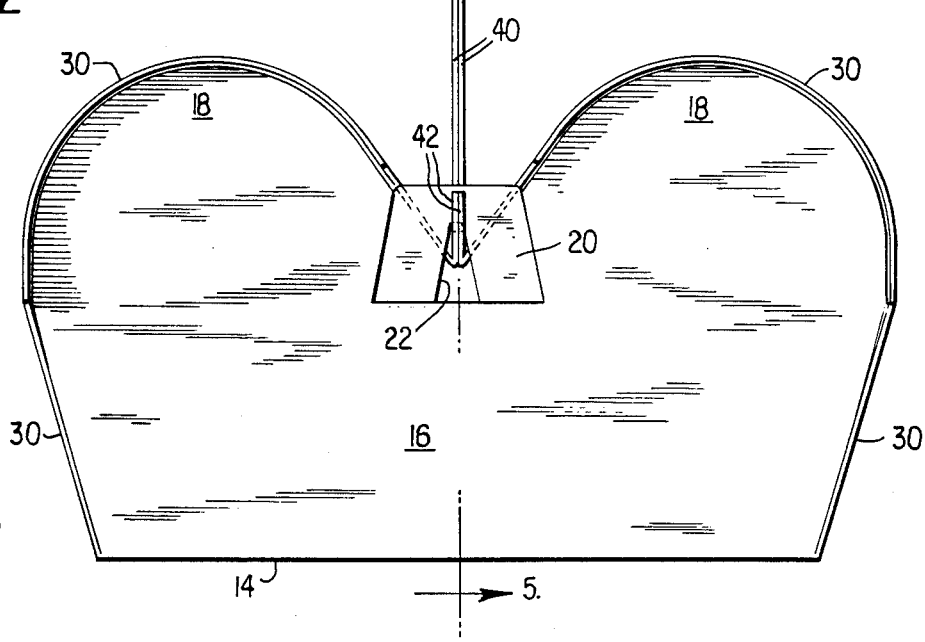
FIG. 3 is an end elevational view of the carton.

Referring now to FIGS. 2–5 of the drawings, the blank of FIG. 1 is folded to form the carton of this invention. End panels 16 are folded about their respective fold axes 50 bordering central panel 14 so as to assume an orientation roughly at right angles to base or bottom panel 14. Then, glue flaps 32, integral with their respective panels 16, are folded about their hinge lines 50 and are glued to respective interior forming portions of top forming panels 30, as shown at FIGS. 4 and 5. After this glueing, panels 16 flare outwardly from bottom 14, also as shown at FIG. 4 and 5. Side and top closure forming panels 30 are also divergent, thereby allowing these partially formed or erected cartons to be stacked. Stacks of the cartons are then shipped to a retailer of food products, such as a fast food outlet wherein food, such as hamburgers or the like, are placed in the cartons as the latter are sequentially removed from the nested stack. To effect complete top closure assembly, panels 30 are thereafter bent around the periphery of respective opposite pairs of ears 18, with handle panels 40 being placed in surface contact, as shown at FIG. 3. The length of free edges 39 of the (longitudinally) central portion of panels 30 is substantially the same as the periphery of semicircular ears 18, as may be seen at FIG. 3. With panels 40 in contact, hooks 42 are also in surface contact and are placed within a respective opening 22 of a respective latching panel 20. This may be easily effected by a slight bending outwardly of latch panels 20 to permit hooks 42 to extend into the respective openings 22. This latching action is shown at FIG. 5. The fast food outlet operator has then packaged a food item and gives it to the consumer for easy handling by virtue of merely placing fingers into aligned handle openings 46. The hooks 42 are retained in their respective apertures by the resiliency of the paperboard, the resiliency of bent sections 30 tending to move the handle 40 upwardly.

The terms left, right, top, bottom, and the like are employed to aid in the description of the invention and are not intended as terms of limitation.

I claim:

1. A unitary blank of paperboard for forming an arched clamshell carton, the blank having both a longitudinal and a transverse axis of mirror symmetry, the blank including cut and fold lines, the blank including a central, rectangular, bottom forming panel having a transversely extending side forming panel at both its upper and lower edges, each side forming panel having a pair of semicircular, spaced ears between which is positioned an apertured latching flap, each said side forming panel having a pair of longitudinally extending glue flaps hinged thereto, a longitudinally extending top and side forming panel at each left and right edge of said central panel, said top and side forming panels each terminating in an apertured, handle forming panel, the latter panels each carrying two hooks.

2. The blank of claim 1 wherein each handle forming panel carries a hook at each upper and lower end thereof.

3. The blank of claim 1 wherein the transverse width of each top and side forming panel is greater along its central portion than at its ends, the longitudinal extent of said central portion being substantially equal to the perimeter of said ears.

4. The blank of claim 1 wherein each of said latching flaps are bendable out of the plane of their said side forming panels.

5. An arched clamshell carton formed from a unitary blank of paperboard, said carton including a rectangular bottom panel having a side wall extending substantially upwardly from each of its edges to thereby define four sidewalls, two opposite sidewalls each being provided with a pair of spaced apart, coplanar semicircular ears, an apertured latching flap positioned between each pair of said ears, the remaining two opposite side walls each extending upwardly and horizontally and then curved downwardly and terminating in a substantially vertically extending and apertured handle panel, said handle panels being in surface to surface contact, each of said handle panels having a pair of hooks on opposite ends thereof, said hooks also being in surface to surface contact to thereby define two hooks each of double thickness of paperboard, each double thickness hook extending in a respective aperture of said latching flap, the top cover of the carton being in the form of a pair of parallel, semicylindrical members, each of said latching flaps being bendable out of the plane of its respective side panel to thereby permit closing and opening of the top of the carton.

6. The carton of claim 5 wherein the length of each of said semicylindrical carton covers is greater than the side of the bottom of the carton from which they extend.

7. The carton of claim 5 wherein the peripheries of respective opposite, aligned pairs of said ears engage interior surface portions of a respective semicylindrical top cover member.

* * * * *